US006179672B1

(12) United States Patent
Tsumiyama et al.

(10) Patent No.: US 6,179,672 B1
(45) Date of Patent: Jan. 30, 2001

(54) LOCKING MECHANISM OF DEFLECTOR FOR WATERCRAFT

(76) Inventors: Yoshinori Tsumiyama, 130-19, Higashi-jiyugaoka 1-Chome, Shijimi-cho, Miki-shi, Hyogo 637-0553; Kenichi Nakagawa, 1-6-632, Izumigaoka 4-Chome, Tarumi-ku, Kobe-shi, Hyogo 655-0885; Tomohiro Kanazawa, 11-5-4112, Shidou 1-Chome, Amagasaki-shi, Hyogo 666-0952; Masafumi Ikeyama, 14-23, Kodukayama 6-Chome, Tarumi-ku, Kobe-shi, Hyogo 655-0002, all of (JP)

( * ) Notice: Under 35 U.S.C. 154(b), the term of this patent shall be extended for 0 days.

(21) Appl. No.: 09/469,564

(22) Filed: Dec. 22, 1999

(30) Foreign Application Priority Data

Dec. 29, 1998 (JP) ..... 10-377500

(51) Int. Cl.[7] ..... B63H 11/11
(52) U.S. Cl. ..... 440/41; 440/38
(58) Field of Search ..... 440/77, 88, 38

(56) References Cited

U.S. PATENT DOCUMENTS 3,336,752 * 8/1967 Smith ..... 440/41
4,026,235 * 5/1977 Woodfill ..... 440/41
4,708,671 11/1987 Watanabe ..... 440/41

* cited by examiner

*Primary Examiner*—Jesus D. Sotelo

(57) ABSTRACT

It is an object to provide a locking mechanism of a deflector for a watercraft which can perform the locking and unlocking operation of the locking mechanism simply by executing up-down movement of the deflector. A locking mechanism (1L) of a deflector (1A) for a watercraft comprises a first member (a locking member) (1E), a second member (an engaging member) (1K) to be engaged with the first member (1E), and a third member (an unlocking member) (1R) for disengaging the first member (1E) from the second member (1R), the first member being attached to a fixing side to be able to engage the second member therewith, the second member being attached to a deflector side, and the third member being capable of performing up-down movement of the deflector (1A), and the engaging state of the first member is released in an initial stage of operation of the third member, the second member is caused to be operated interlockingly at a succeeding stage to perform the up-down movement of the deflector, and the second member is brought into the engaging state by the first member in a succeeding final stage.

5 Claims, 10 Drawing Sheets

LOCKING MECHANISM OF DEFLECTOR FOR WATERCRAFT

BACKGROUND OF THE INVENTION

1. Field of the Invention

The invention relates to a reverser for a watercraft which allows the watercraft to go in reverse, and more particularly to a locking mechanism for locking a deflector functioned as the reverser at a predetermined position.

2. Description of the Related Art

A watercraft which is propelled by a water jet pump, for example, a personal watercraft (which is also referred to as a "PWC") has a structure to suck water (including sea water) through a water intake hole provided on a bottom of a hull, to pressurize the water by the water jet pump and to eject the water rearward from the hull through an outlet port of the water jet pump, thereby moving the PWC forward.

When going rearwardly, a deflector liftably (movably) is provided behind the steering nozzle and positioned in a portion behind the steering nozzle (brought down), thereby changing the direction of a water flow ejected rearward from the steering nozzle into a forward direction. Thus, the body of the watercraft can go in reverse.

An up-down movement of the deflector is performed by operating a deflector operation lever provided closely to a steering handle through an operation wire which connects the deflector operation lever and deflector.

The deflector has a locking mechanism provided between the deflector and the body side in such a manner that the deflector is fixed into an upper retracted position when going forward and is fixed into a position behind the steering nozzle when going astern.

Conventionally, the locking mechanism has been constituted to be operated through an operation wire by operating a lock operation lever provided near the deflector operation lever.

More specifically, the up-down movement of the deflector and the operation of the locking mechanism are performed by operating separate operation levers using separate operation wires. Accordingly, when a rider wants to go astern it is necessary to move the deflector from the retracted position down to a position behind the steering nozzle, for example, it is necessary to first operate the lock operation lever to perform unlocking, then operate the deflector operation lever to bring the deflector down to a predetermined position and thereafter operate the lock operation lever again to perform locking. When the forward movement is desired after going astern, the same two operations as described above are required.

Moreover, respective operation levers should be provided on a structural basis. In addition, through holes for operation wire should be formed on the body and installation spaces of the wires should be provided. Thus, the operation wires should be provided to reach a stern portion, respectively. Correspondingly, the number of parts is increased and an assembly man-hour is also increased. Thus, manufacturing cost is increased.

SUMMARY OF THE INVENTION

In consideration of the forgoing circumstances it is an object of the invention to provide a locking mechanism of a deflector for a watercraft which can lock and unlock the locking mechanism by simply performing an up-down movement of the deflector.

A first aspect of the invention is directed to a locking mechanism of a deflector for a watercraft which locks, in a predetermined position, the deflector movably provided behind a pump nozzle of a water jet pump to change the direction of water flow ejected rearward from the pump nozzle, thereby moving the watercraft astern, wherein the locking mechanism comprises a first member, a second member engaged with the first member, and a third member for disengaging the first member from the second member, the first member being attached to a fixture to be able to engage the second member, the second member being attached to the deflector side, and the third member being capable of performing up-down movement of the deflector, and the engaging state of the first member and the second member is released in an initial stage of operation of the third member, the second member is caused to be operated interlockingly to perform the up-down movement of the deflector at a succeeding stage of operation of the third member, and the second member is brought into the engaging state by the first member in a succeeding final stage of operation of the third member.

According to the locking mechanism of the deflector for a watercraft of the invention which has the above-mentioned structure, the second member is interlocked by simply operating the third member. Consequently, the deflector can perform the up-down movement by operating the third member and the first member is engaged with the second member on both ends of the up-down movement. Therefore, it is possible to obtain the mechanism which can perform locking and unlocking on the both ends.

In the locking mechanism of a deflector for a watercraft, it is possible that the first member is a locking member, the second member is an engaging member and the third member is an unlocking member.

In the locking mechanism of a deflector for a watercraft, it is preferable that the engaging member is provided with a concave portion with which a part of the locking member is engaged and, the locking member is provided with a pressed portion for contact and pressing of the unlocking member, and the unlocking member is provided with a pressing portion for pressing the pressed portion of the locking member to remove the locking member in engaging state from the concave portion of the engaging member.

In the locking mechanism of a deflector for a watercraft, it is preferable that the engaging member and the unlocking member are able to rotate on a concentric pivot within a range of a predetermined angle, and a slot is formed around the pivot on one of the engaging member and the unlocking member and an interlocking pin to be inserted into the slot and engaged with both ends of the slot is projected onto the other one of the engaging member and the unlocking member, thereby operating the engaging member interlockingly with the unlocking member at a stage succeeding to the initial stage of the operation of the unlocking member.

In the locking mechanism of a deflector for a watercraft, it is preferable that the concave portion of the engaging member is formed on a peripheral edge portion of the engaging member to enter the pivot side, and a tip of the locking member may be engaged with the concave portion, and the locking member is energized by a spring toward the peripheral edge portion of the engaging member.

These objects as well as other objects, features and advantages of the invention will become more apparent to those skilled in the art from the following description reference to the accompanying drawings.

DETAILED DESCRIPTION OF THE PREFERRED EMBODIMENT

A locking mechanism of a deflector for a watercraft according to an embodiment of the invention will be described below with reference to the drawings by taking, as an example, the case where the locking mechanism of the deflector is used for a personal watercraft.

Figure 1:
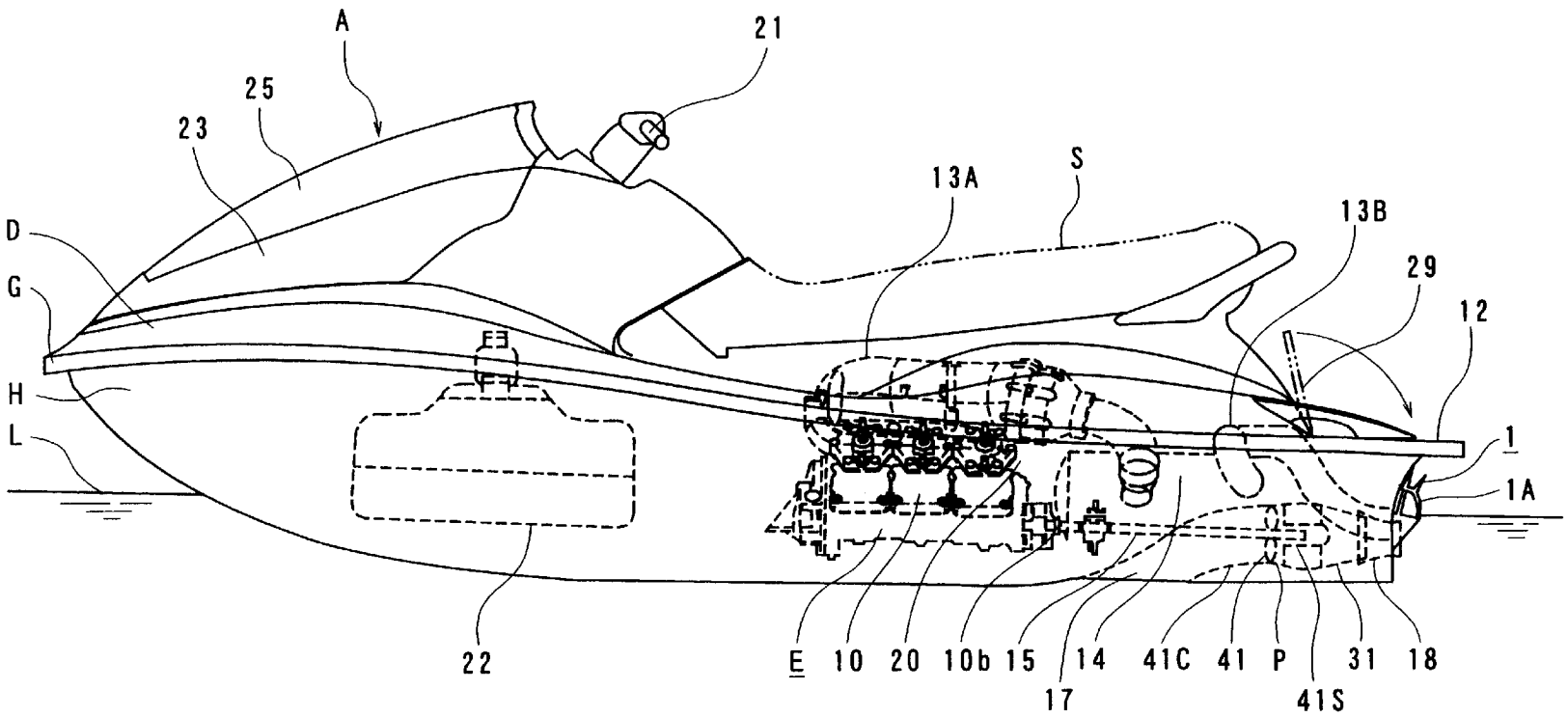
FIG. 1 is a side view showing a personal watercraft comprising a locking mechanism of a deflector according to an embodiment of the invention.
Figure 2:
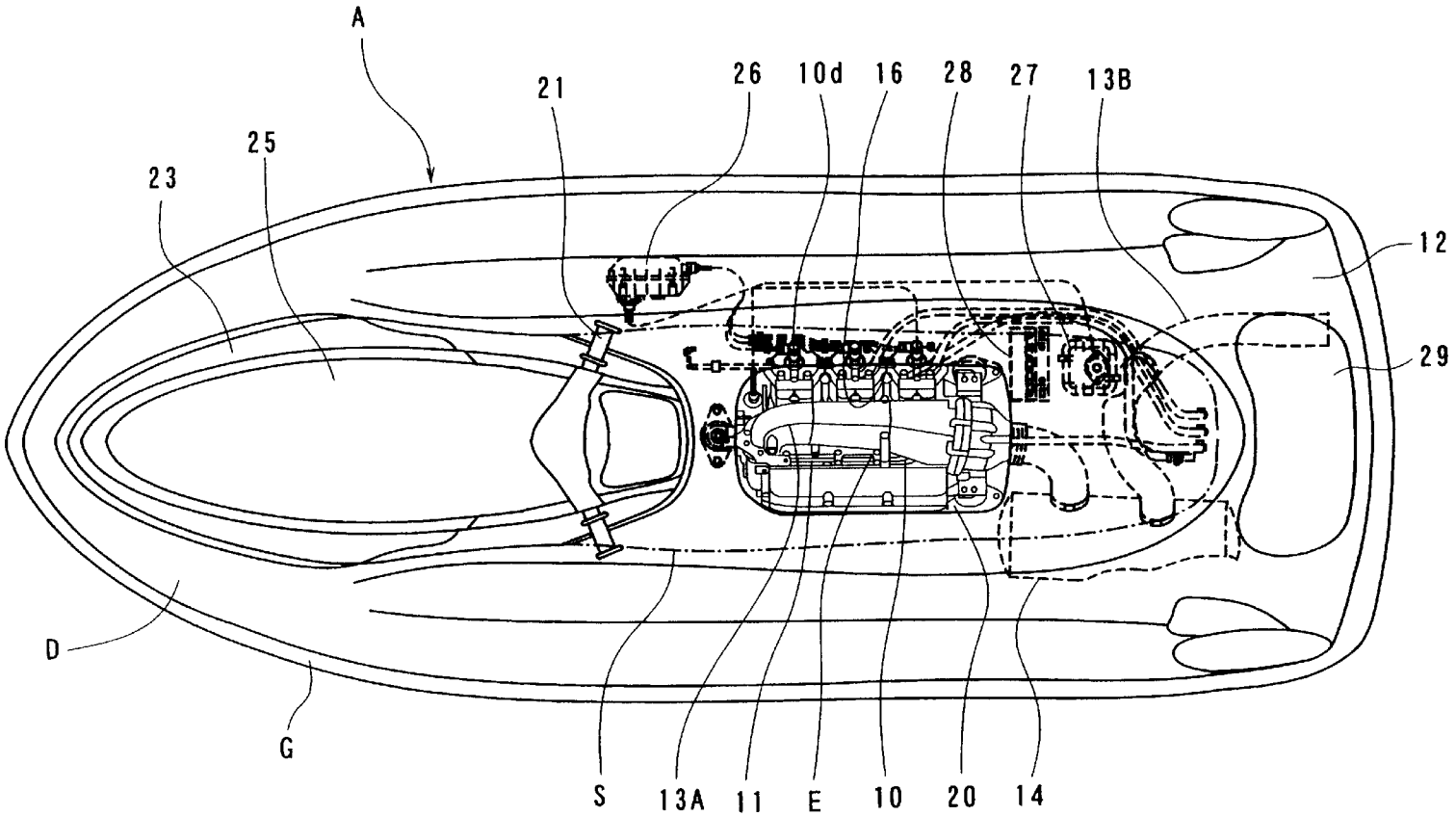
FIG. 2 is a plan view showing the personal watercraft illustrated in FIG. 1.

In FIGS. 1 and 2, A denotes a body of the personal watercraft. The body A comprises a hull H and a deck D covering an upper portion of the hull H. A line for connecting the hull H to the deck D over the entire periphery is referred to as a gunwale line G. In the illustrated embodiment, the gunwale line G is positioned above a waterline L of the personal watercraft.

An opening 16 having a top face almost rectangular as seen in a plane view along the longitudinal direction of the body A is formed slightly behind the center of the deck D as shown in FIG. 2. As shown in FIGS. 1 and 2, a riding seat S is provided above the opening 16.

An engine E is provided in a space (referred to as an "engine space") 20 having a convex cross-sectional shape surrounded by the hull H and the deck D below the seat S.

Figure 3:
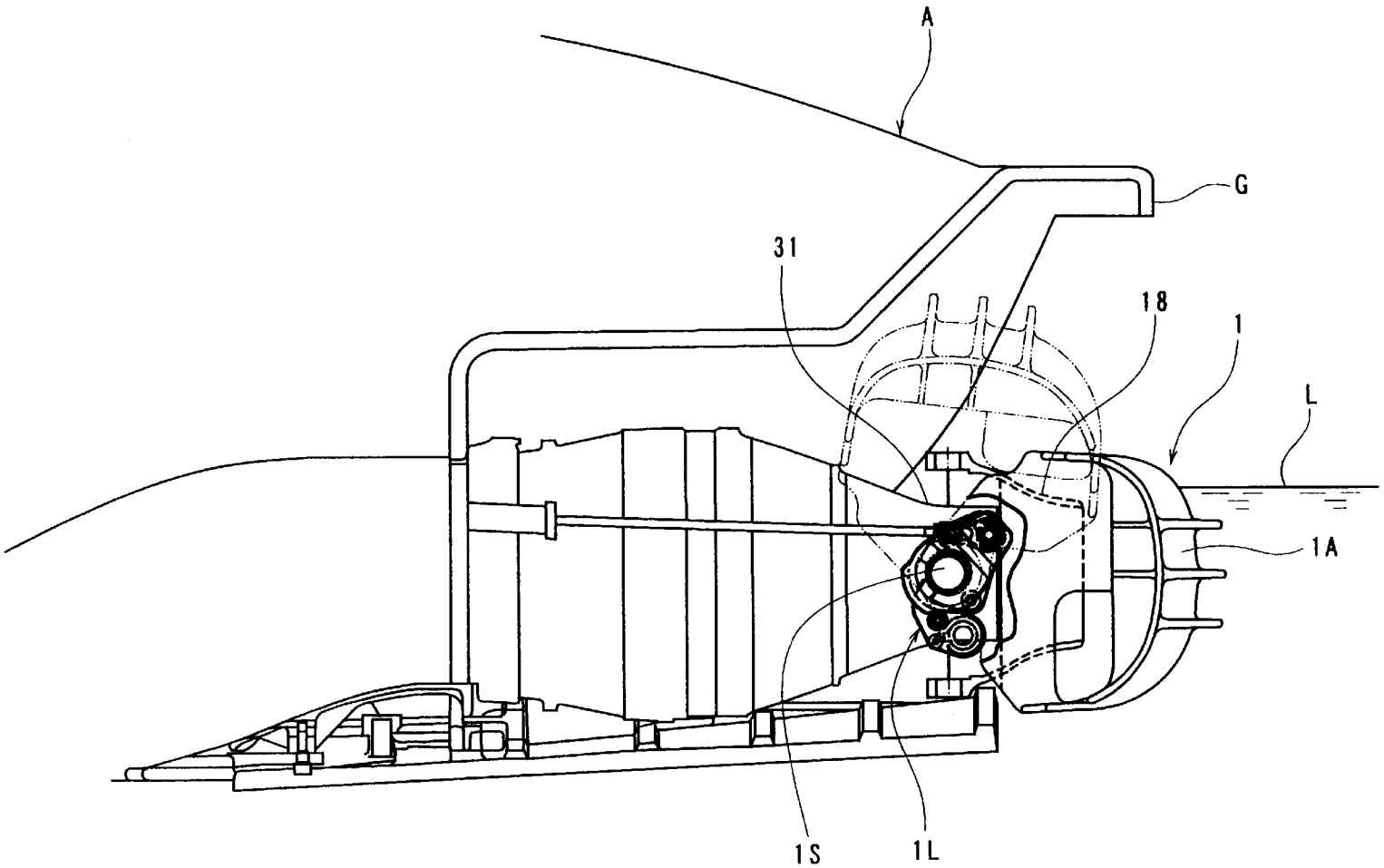
FIG. 3 is an enlarged side view showing a locking mechanism portion in a state in which the deflector illustrated in FIG. 1 is brought down.

The engine E is a multi-cylinder (three-cylinders in the embodiment) engine. As shown in FIG. 1, a crankshaft 10*b* of the engine E is mounted in the longitudinal direction of the body A. As shown in FIG. 2, a carburetor 11 and an air intake chamber (not shown) connected thereto are provided on the left side of an engine block 10 (the port side, or left board of the personal watercraft). As shown in FIGS. 1 and 2, an exhaust pipe 13A is provided above the engine block 10. The exhaust pipe 13A is connected to a silencer 14 provided at the oblique left side portion behind the engine block 10. An exhaust pipe 13B having a terminal reaching the outside of the rear end of the body A from the silencer 14 is provided above a water jet pump P. As shown in FIG. 1 and 3, an output end of the crankshaft 10*b* projecting from the rear portion of the engine block 10 is rotatably coupled integrally with the tip portion of an impeller 41 of the water jet pump P through a propeller shaft 15. Furthermore, the rear end portion of the impeller 41 is coupled integrally with a pump shaft 41S of the water jet pump P. The impeller 41 is covered with a pump casing 41C on the outer periphery thereof. The water pump P sucks water from a water intake (water feeding port) 17 provided on the bottom of the hull through a water intake passage, and pressurizes and accelerates the water. The pressurized and accelerated water is ejected from an outlet port provided on the rear end of an pump nozzle 31 having a cross-sectional area of flow gradually reduced rearward, thereby obtaining propulsive force. In FIGS. 1 and 2, the reference numeral 21 denotes a steering handle. By operating the handle 21 right and left side, a steering nozzle 18 provided behind the pump nozzle 31 is swung from right side to left side so that steering can be performed in a desired direction. A deflector 1A for reverse (see FIG. 1) is provided with the body A through a fixture member 1D (see FIG. 4) above the rear side of the steering nozzle 18 such that it can be swung downward around a swinging shaft 1S (see FIG. 3) provided horizontally. By swinging down the bowl-shaped deflector 1A toward a lower position behind the steering nozzle 18 by operating a deflector operation lever (not shown), the water to be discharged rearward from the steering nozzle 18 is turned lateral direction. Consequently, the personal watercraft can move in reverse.

In the reverser 1 according to the embodiment, in a state in which the deflector 1A is rocked upward (raised) around the pivot 1S (see FIG. 3), it is positioned on the surface of the water as shown in a solid line of FIG. 1 (or a two-dot chain line of FIG. 3). On the other hand, in a state in which the deflector 1A is rocked downward (brought down), it is positioned behind the steering nozzle 18 as shown in a solid line of FIG. 3.

In FIGS. 1 and 2, the reference numeral 12 denotes a rear deck. The rear deck 12 is provided with an openable hatch cover 29. A housing box having a small capacity is formed under the hatch cover 29. In FIG. 1, the reference numeral 22 denotes a fuel tank for supplying fuel to the engine E, and the reference numeral 23 denotes a front hatch cover. A box (not shown) for housing fittings and the like is provided under the hatch cover 23. Another hatch cover 25 is provided over the front hatch cover 23, thereby forming a double hatch cover. A life jacket and the like can be housed under the hatch cover 25.

In FIG. 2, the reference numeral 26 denotes an ignition device for supplying high voltage electricity to an ignition plug 10*d* of the engine E in proper timing, the reference numeral 27 denotes an oil tank, and the reference numeral 28 denotes a battery.

The reverser 1 according to the embodiment of the invention is provided with a locking mechanism 1L (see FIG. 3) for locking the deflector 1A into a predetermined position which will be described below.

Figure 4:
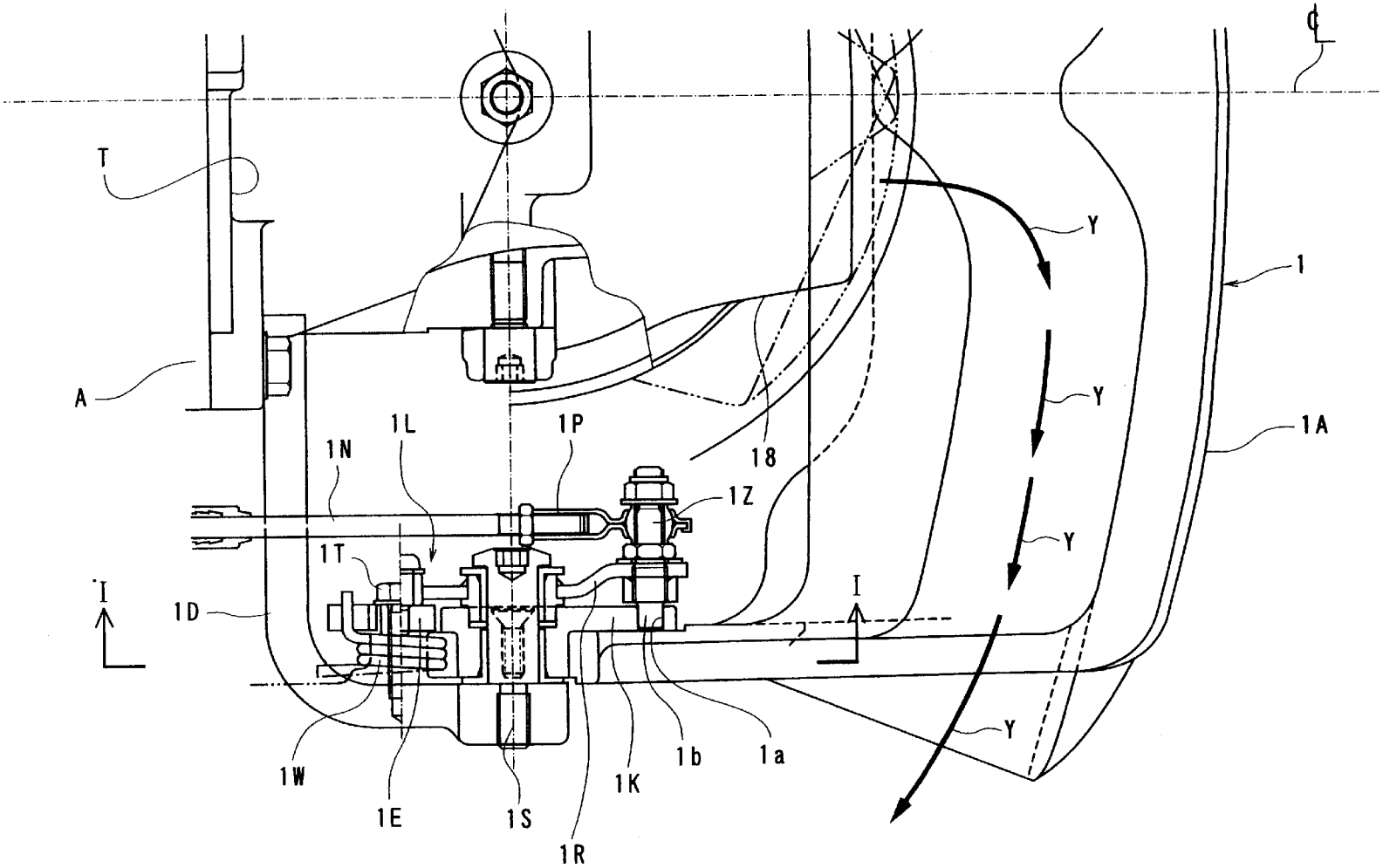
FIG. 4 is a further enlarged partial sectional plan view showing the locking mechanism portion in a state in which the deflector illustrated in FIG. 1 is brought down and is locked.
Figure 7:
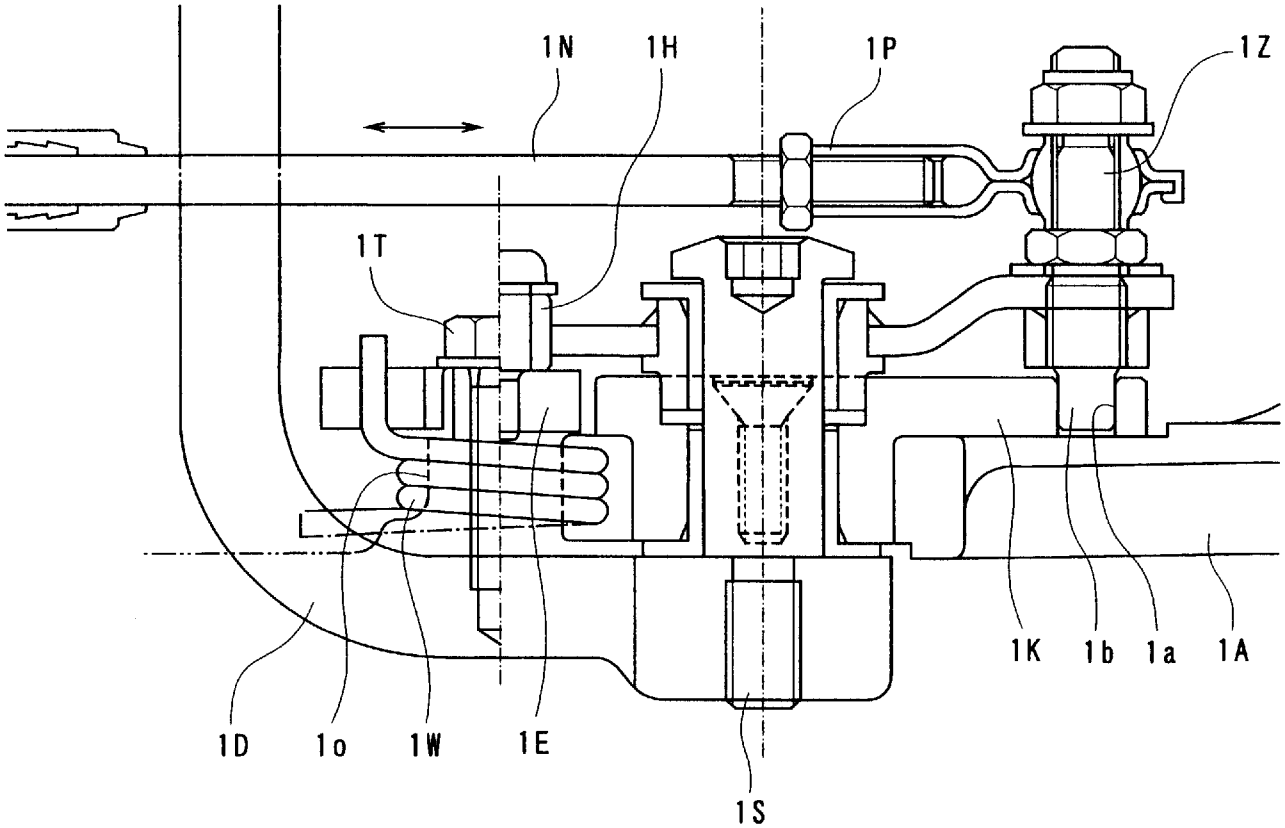
FIG. 7 is a further enlarged partial plan view showing the locking mechanism portion illustrated in FIG. 4.

As shown in FIG. 4 or 7, the deflector 1A is swingably provided through the pivot 1S on the fixture member 1D which is attached to a transom T of the body A and has a general U shape seen on a plane view. The pivot 1S is fixed (screwed) into the fixture member 1D. An engaging member (a second member) 1K and an unlocking member (a third member) 1R is pivoted concentrically and rotatably on the pivot 1S.

Figure 5:
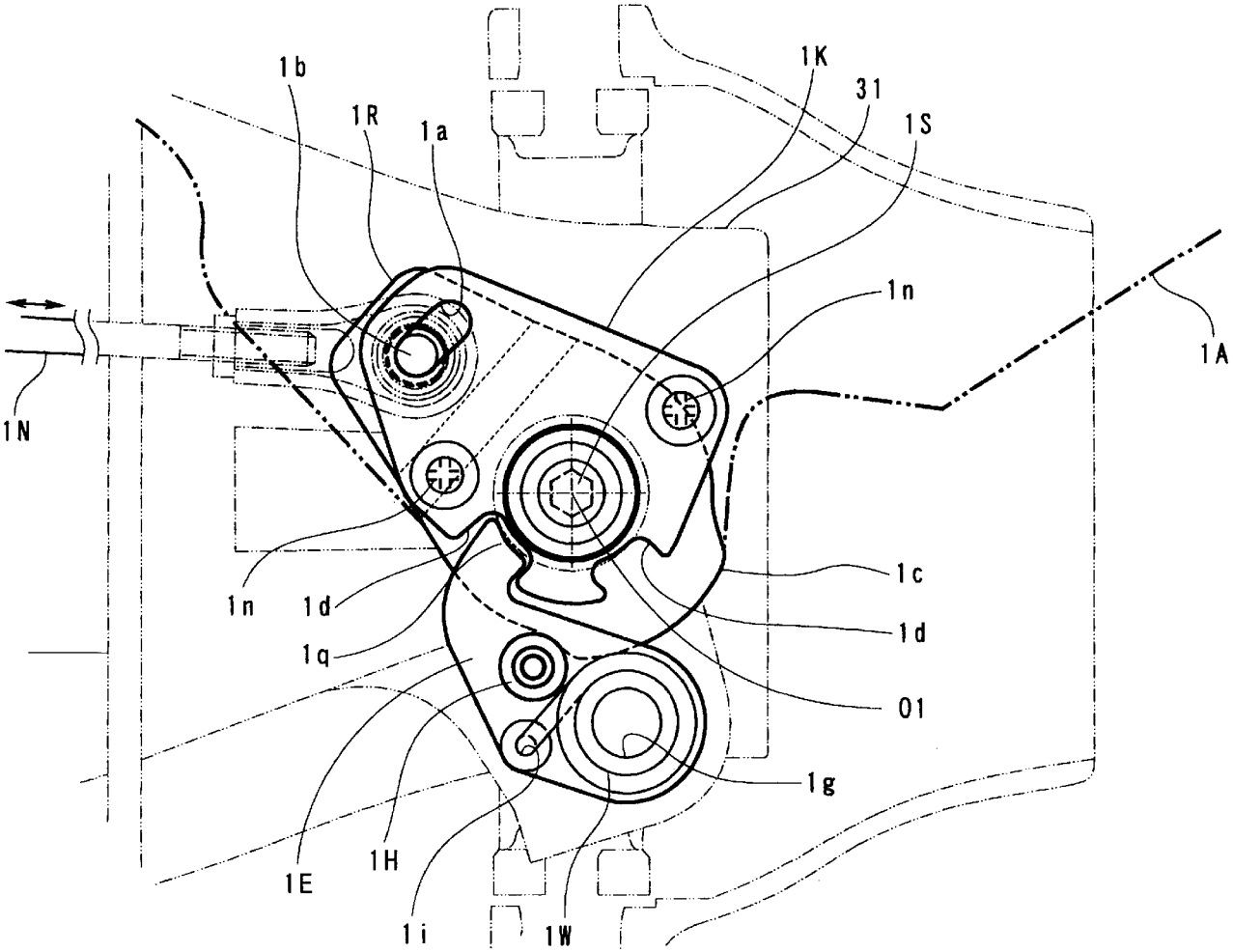
FIG. 5 is a further enlarged side view showing the locking mechanism portion, illustrating a locking state in which the deflector is raised up from the state illustrated in FIG. 6.
Figure 6:
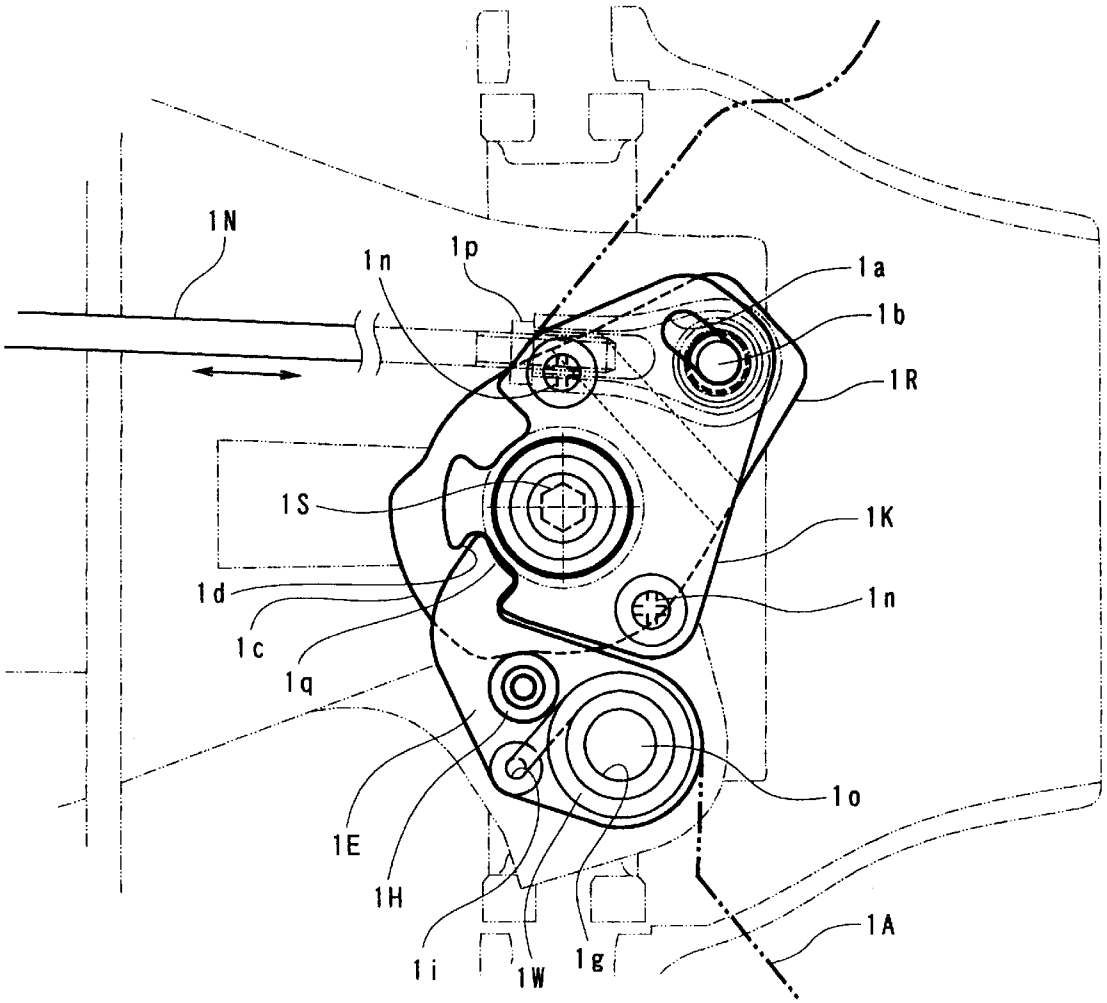
FIG. 6 is a further enlarged side view taken along the line I—I in FIG. 4 corresponding to FIG. 5, showing the locking state in which the deflector is brought down from the state illustrated in FIG. 5.
Figure 9A:
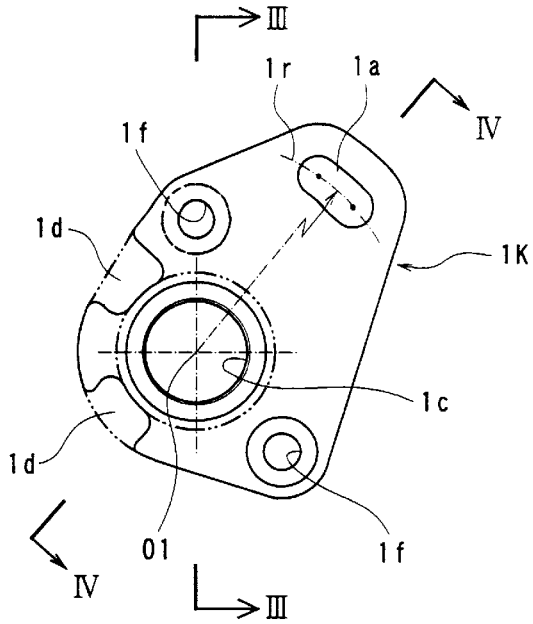
FIG. 9 shows the detailed configuration of an engaging member of the locking mechanism illustrated in FIGS. 4 to 7, FIG. 9A being a side view, FIG. 9B being a view taken along the line III—III of FIG. 9A, and FIG. 9C being a view taken along the line IV—IV of FIG. 9A.
Figure 9B:
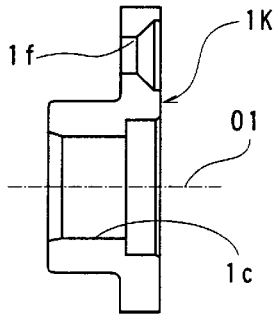
Figure 9C:
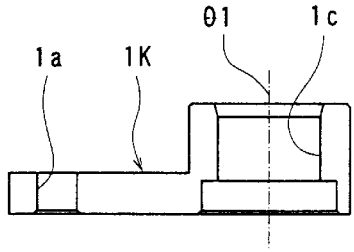

As shown in FIG. 9, the engaging member 1K shown in FIGS. 5 and 6 is provided with a slot la having a predetermined width. The slot 1*a* uses, for a longitudinally central axis, a virtually partial circle 1*r* having a center O1 of rotation consist of a center of the pivot 1S. On the other hand, an interlocking pin 1*b* having a diameter almost equal to (accurately, slightly smaller than) the predetermined width of the slot 1*a* is screwed to be projected from a side face of the unlocking member 1R toward the engaging member 1K side as shown in FIGS. 4 and 7. In the embodiment, a base end of the interlocking pin 1*b* is greatly projected from a side face of the counter side of the engaging member 1K of the unlocking member 1R. A tip of a wire 1N for remotely controlling the deflector 1A is fixed to the projected portion 1*z* through a fixture parts 1P.

As shown in FIGS. 4 and 7, a locking member (a first member) 1E is provided on the fixture member 1D in such a manner that it is aligned with the engaging member 1K in the longitudinal direction of the body seen on a plane view.

The engaging member 1K is provided with concave portions 1*d* into which a tip portion of the locking member 1E can be inserted. The concave portions 1*d* are obtained by cutting out a plate-shaped member into a shape shown in FIGS. 5 and 9 and are provided in two portions on a peripheral edge which are set equally apart from the center O1 of rotation in a radiation direction toward the center O1 side. Moreover, a through hole 1*c* for inserting the pivot 1S therein is formed in the center portion of rotation of the engaging member 1K. Furthermore, the engaging member 1K is provided with a through hole 1*f* for a fixing screw so as to be integral with the side face of the deflector 1A in two portions thereof.

Figure 10A:
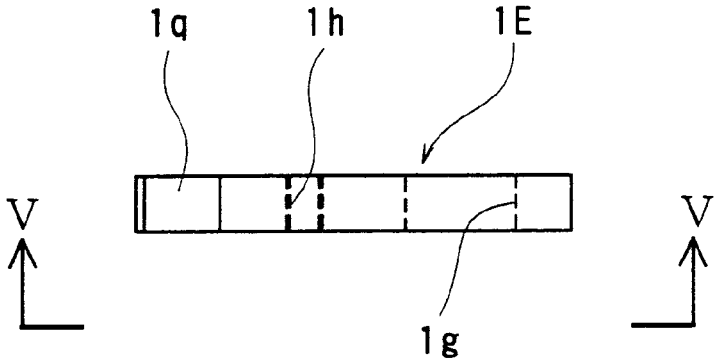
FIG. 10 shows the detailed configuration of a locking member of the locking mechanism illustrated in FIGS. 4 to 7, FIG. 10A being a plan view and FIG. 10B being a view taken along the line V—V of FIG. 10A.
Figure 10B:
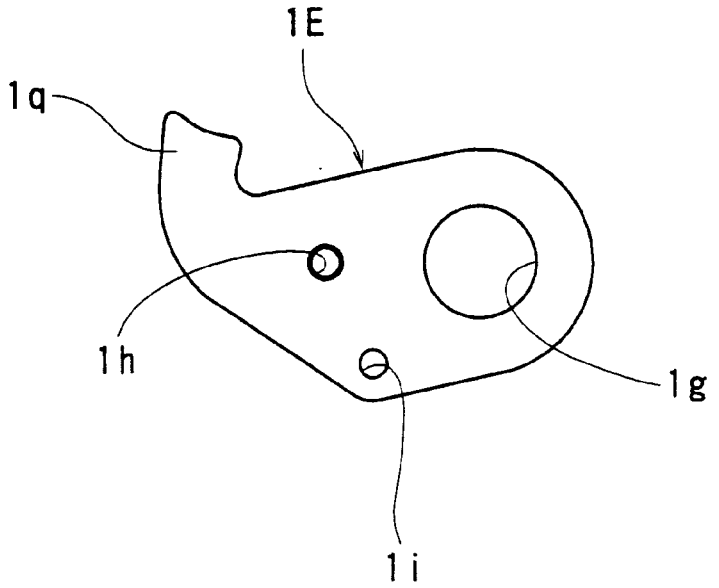

The locking member 1E is obtained by cutting out a plate-shaped member having the same thickness as the thickness of the engaging member 1K into a so called gourd-like "ratchet" shape having one of ends which is click-shaped and the other end which is bulged as shown in FIGS. 5 and 10. A fixing through hole 1*g* is formed on a central part of a bulged base end. A female screw hole 1*h* for pivotally fixing a rotary roller 1H acting as a pressed portion is formed in a portion apart from the through hole 1*g* outward in a radial direction. An engaging hole 1*i* for engaging one of ends of an energizing spring ("a coiled spring" in the embodiment) 1W (see FIGS. 4 to 7) is provided in a portion apart from the female screw hole 1*h*.

Figure 8A:
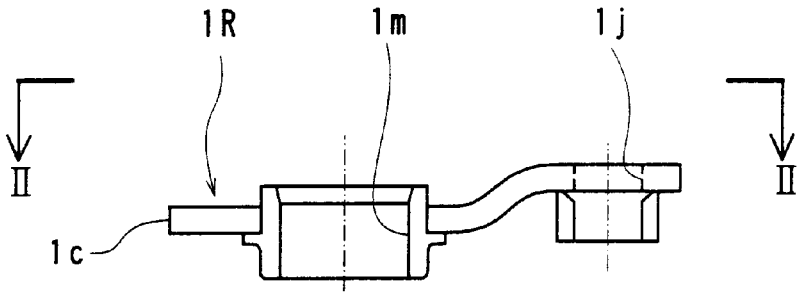
FIG. 8 shows the detailed configuration of an unlocking member of the locking mechanism illustrated in FIGS. 4 to 7, FIG. 8A being a plan view and FIG. 8B being a view (a side view) taken along the line II—II of FIG. 8A.
Figure 8B:
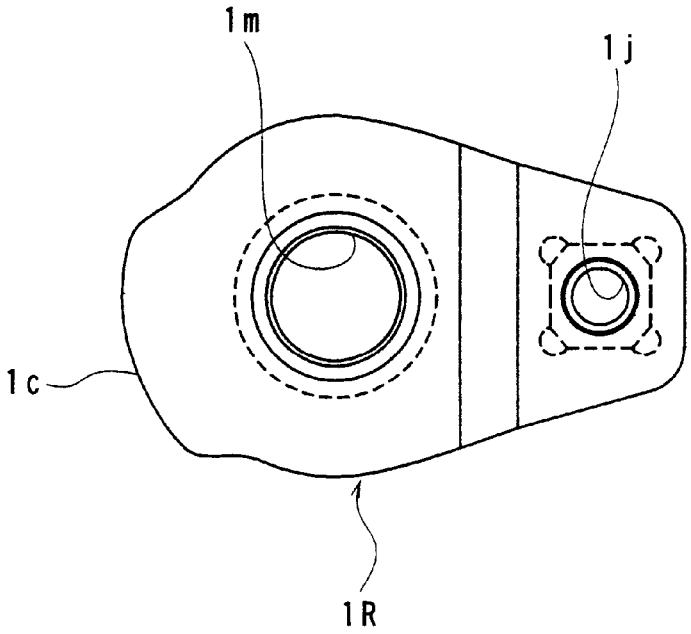

Moreover, the unlocking member 1R is a plate member which is thinner than the engaging member 1K and the locking member 1E, has such a shape as to be extended from an almost circular central portion to both ends as shown in FIGS. 5 and 8, and has a cam face 1*c* formed on one of ends extended to both sides and a screwing hole 1*j* for screwing the interlocking pin 1*b* (see FIGS. 4 and 7) formed on the other end. Furthermore, a through hole 1*m* for inserting the pivot 1S (see FIGS. 4 and 7) therein is formed in the central part, and the other end (on the side where the screwing hole 1*j* is formed) is provided with a bent portion projected toward counter side of the engaging member 1K with respect to the central part.

The engaging member 1K and the unlocking member 1R are attached to the fixture member 1D rotatably through the pivot 1S as described above in a state in which a tip of the interlocking pin 1*b* screwed to the unlocking member 1R is inserted in the slot 1*a* of the engaging member 1K as shown in FIGS. 4 and 7. Moreover, the engaging member 1K is fixed to the deflector 1A through a fixing screw In (see FIG. 6) by means of the through holes 1*f* (see FIG. 9) provided in two portions. Accordingly, when the deflector 1A performs up-down movement (swinging), the engaging member 1K is integrally rotated around the pivot 1S. Furthermore, the unlocking member 1R is also rotated interlockingly with the engaging member 1K with an idling state in a "play(idle gap)" portion of the slot 1*a* and the interlocking pin 1*b*. In other words, the unlocking member 1R is not relatively interlocked with the engaging member 1K only within the range of the "play".

As shown in FIGS. 4, 6 and 7, the locking member 1E is rotatably provided, with a fixing bolt 1T, on a cylindrical portion lo of the fixture member 1D projected from the inner face of the fixture member 1D. As shown in FIGS. 5 and 6, moreover, the locking member 1E is energized with the coiled-shaped spring 1W in such a manner that a click-shaped tip portion 1*q* of the locking member 1E is pressed and joined onto a peripheral portion where the concave portion 1*d* of the engaging member 1K is formed. More specifically, the spring 1W has one of its ends engaged with the engaging hole 1*i* (see FIGS. 5 and 6) of the locking member 1E and the other end engaged with the fixture member 1D (see FIG. 4).

The wire 1N has one of its ends attached to the unlocking member 1R through the fixture parts 1P shown in FIG. 4 and the other end coupled to a deflector operation lever (not shown) provided in the vicinity of a handle 21 ahead of a driving seat of a personal watercraft shown in FIG. 1. By operating the deflector operation lever, the up-down movement and locking operation of the deflector 1A can be performed.

In the embodiment, moreover, the deflector 1A has the shape of a helmet of American football seen from a side as shown in FIG. 3 and a pillow-shape, that is, an almost oval shape seen on a plane as shown in FIG. 4 illustrating a section taken from a center to a right half.

The locking mechanism 1L of the deflector 1A having such a structure can perform locking and unlocking with the up-down movement(swinging) of the deflector 1A as will be described below. For example, in the case where the personal watercraft is set in a forward moving state, the deflector 1A is positioned above a portion behind the pump nozzle 31 as shown in FIG. 1. In this state, the locking mechanism is set in a state shown in FIGS. 1 and 5. More specifically, in a state in which the deflector 1A is raised, the click-shaped tip portion 1*q* of the locking member 1E rotatably fixed to the fixture member 1D side is engaged with the concave portion 1*d* of the engaging member 1K provided integrally with the deflector 1A side as shown in FIG. 5 and the locking member 1E is energized clockwise with the spring 1W in FIG. 5. In addition, in a state in which the tip portion 1*q* of the locking member 1E is engaged with the concave portion 1*d* of the engaging member 1K, if external force with the exception of that of through the wire 1N to rotate the engaging member 1K clockwise around the pivot 1S acts the deflector 1A side, the external force does not generate such a component of force as to rotate the locking member 1E due to the engaged shape (engaged state) of the concave portion 1*d* and the tip portion 1*q*. For this reason, in this state, the deflector 1A cannot be rotated counterclockwise in FIG. 5. In other words, the deflector 1A is set to a so-called locking state in which it cannot be brought down.

In the case where the rider reverses the personal watercraft, the wire 1N is moved to the right in FIG. 5 when the deflector operation lever is operated to the reverse mode side, only the unlocking member 1R can be rotated clockwise by the "play" because of the "play" of the slot 1*a* and the interlocking pin 1*b* when the unlocking member 1R is to be rotated clockwise in FIG. 5, and the cam face 1*c* of the unlocking member 1R presses the locking member 1E counterclockwise through the rotary roller 1H in FIG. 5. Consequently, the locking member 1E is rotated counterclockwise against the spring force of the spring 1W. As a result, the clickshaped tip portion 1*q* of the locking member 1E gets out of the concave portion 1*d* of the engaging member 1K so that the unlocking is performed.

In the initial stage of the up-down movement of the deflector 1A, the engaging member 1K is not rotated clockwise interlockingly with the clockwise rotation of the unlocking member 1R in FIG. 5 because the interlocking pin 1*b* is movably fitted in the slot 1*a*. When the wire 1N is further moved to the right in FIG. 5 to rotate the unlocking member 1R clockwise in FIG. 5, the unlocking member 1R is further rotated clockwise in FIG. 5. During the rotation, the cam face 1*c* of the unlocking member 1R continuously presses the locking member 1E counterclockwise through the rotary roller 1H in FIG. 5 and the interlocking pin 1*b* is engaged with the end of the slot 1*a* and interlocked. Consequently, the deflector 1A is brought down.

In the final stage of the operation of the deflector 1A in which the wire 1N is further moved to the right in FIG. 5 to be extended most, the cam face 1*c* of the unlocking member 1R has a curved shape (recessed shape) toward the center of rotation as shown in FIG. 6, thereby stopping pressing the locking member 1E counterclockwise through the rotary roller 1H in FIG. 5. As a result, the tip portion 1*q* of the locking member 1E is engaged with one of the concave portions 1*d* formed apart from the another concave portions 1*d* in the engaging member 1K. Therefore, the engaging member 1K is locked in that position.

According to the locking mechanism 1L of the embodiment, the locking or unlocking can be performed with the up-down movement of the deflector 1A simply by remotely controlling the deflector operation lever to move one wire 1N fore-side and back-side directions of the body A. Consequently, the locking mechanism of the deflector makes it possible to easily change from forward to reverse.

Also in respect of manufacture, the number of parts can be reduced and the number through holes provided on the body can be decreased. Accordingly, manufacturing manhours can also be reduced.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A locking mechanism of a deflector for a watercraft which locks, in a predetermined position, the deflector movably provided behind an pump nozzle of a water jet pump to change a direction of a water flow ejected rearward from the pump nozzle, thereby a body of the watercraft go astern, wherein the locking mechanism comprises a first member, a second member to be engaged with the first member, and a third member for disengaging the first member from the second member, the first member being attached to a fixing side to be able to engage the second member, the second member being attached to a deflector side, and the third member being capable of performing up-down movement of the deflector, and the engaging state of the first member and the second member is released in an initial stage of operation of the third member, the second member is caused to be operated interlockingly to perform the up-down movement of the deflector at a succeeding stage of operation of the third member, and the second member is brought into the engaging state by the first member in a succeeding final stage of operation of the third member.

2. The locking mechanism of a deflector for a watercraft according to claim 1, wherein said first member is constituted by a locking member, said second member is constituted by an engaging member and said third member is constituted by an unlocking member.

3. The locking mechanism of a deflector for a watercraft according to claim 2, wherein said engaging member is provided with a concave portion with which a part of the locking member is engaged and, said locking member is provided with a pressed portion for contact and pressing of the unlocking member, and said unlocking member is provided with a pressing portion for pressing the pressed portion of the locking member to remove the locking member in engaging state from the concave portion of the engaging member.

4. The locking mechanism of a deflector for a watercraft according to claim 3, wherein said engaging member and said unlocking member are provided to be able to rotate on a concentric pivot within a range of a predetermined angle, and a slot is formed around the pivot on one of the engaging member and the unlocking member and an interlocking pin to be inserted into the slot and engaged with both ends of the slot is projected onto the other one of the engaging member and the unlocking member, thereby operating the engaging member interlockingly with the unlocking member at a stage succeeding to the initial stage of the start of the operation of the unlocking member.

5. The locking mechanism of a deflector for a watercraft according to claim 4, wherein said concave portion of the engaging member is formed on a peripheral edge portion of the engaging member to enter the pivot side, and a tip of the locking member is constituted to be engaged with the concave portion, and the locking member is energized by a spring toward the peripheral edge portion of the engaging member.

* * * * *